US007364400B2

(12) United States Patent
Ku et al.

(10) Patent No.: US 7,364,400 B2
(45) Date of Patent: Apr. 29, 2008

(54) COOLING FAN HAVING IMPROVED OIL SEALING STRUCTURE

(75) Inventors: Chin-Long Ku, Tu-Cheng (TW); Chin-Wen Yeh, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 352 days.

(21) Appl. No.: 11/200,330

(22) Filed: Aug. 9, 2005

(65) Prior Publication Data

US 2006/0034714 A1 Feb. 16, 2006

(30) Foreign Application Priority Data

Aug. 13, 2004 (CN) ..... 2004 1 0051152

(51) Int. Cl.
*F04D 29/06* (2006.01)

(52) U.S. Cl. ..... 415/111; 415/229

(58) Field of Classification Search ..... 415/111, 415/290, 230; 416/170 R; 310/90, 67 R
See application file for complete search history.

(56) References Cited

U.S. PATENT DOCUMENTS 5,441,386 A 8/1995 Hsieh
5,610,462 A 3/1997 Takahashi
6,309,191 B1 * 10/2001 Hu ..... 417/423.12
6,376,946 B1 * 4/2002 Lee ..... 310/67 R
6,707,199 B2 * 3/2004 Chang et al. ..... 310/90

FOREIGN PATENT DOCUMENTS

| | | |
|---|---|---|
| CN | 2160029 Y | 3/1994 |
| TW | 426116 | 3/2001 |
| TW | 454829 | 9/2001 |
| TW | 554963 | 9/2003 |

* cited by examiner

*Primary Examiner*—Ninh H. Nguyen
(74) *Attorney, Agent, or Firm*—Morris Manning Martin LLP; Tim Tingkang Xia, Esq.

(57) ABSTRACT

A cooling fan includes a frame (30), a stator (20) and a rotor (10). The frame includes a base (32) having a central tube (34). A bearing (22) is received in the central tube. The rotor includes a hub (11) having a shaft (15) extending from the hub into the bearing. An oil retaining ring (40) is mounted on the hub around the shaft and near a top of the central hub.

15 Claims, 6 Drawing Sheets

COOLING FAN HAVING IMPROVED OIL SEALING STRUCTURE

TECHNICAL FIELD

The present invention relates to a cooling fan, and more particularly relates to a cooling fan having an improved oil retaining ring.

BACKGROUND

With continuing development of the electronic technology, electronic packages such as CPUs (central processing units) are generating more and more heat that is required to be dissipated immediately. Cooling fans are commonly used in combination with heat sinks for cooling the CPUs.

Referring to FIG. 12, a conventional cooling fan comprises a rotor 1 having a shaft 2 extending downwardly from a central portion of the rotor 1, a bearing 3 defining an inner hole for receiving the shaft 2 therein, and a frame 4. A central tube 5 is located at a middle portion of the frame 4. The bearing 3 impregnated with oil is secured in the central tube 5 to rotatably support the rotor 1. An oil retaining ring 6 is mounted around the shaft 2 and contacts a top end of the bearing 3 directly when the cooling fan is assembled.

During operation of the fan, the oil retaining ring 6 is rotated with the shaft 2. A friction is generated between the oil retaining ring 6 and the bearing 3, which results in a lot of heat being generated and temperature of the oil retaining ring 6 being raised. Due to the raise of temperature, the oil retaining ring 6 becomes easily aging and worn. When the oil retaining ring 6 is worn, it can no longer keep the oil from leaking out of the bearing 3, and the friction between the shaft 2 and the bearing 3 increases. Finally the useful life of the cooling fan is shortened.

What is needed, therefore, is a cooling fan having an improved oil sealing structure wherein during operating of the cooling fan, the oil retaining ring will not be subjected to friction with the bearing, and temperature of the oil retaining ring will not be raised.

SUMMARY OF THE INVENTION

According to a preferred embodiment of the present invention, a cooling fan comprises a frame comprising a base having a central tube, a bearing received in the central tube, a rotor comprising a hub having a shaft extending from the hub into the bearing, and an oil retaining ring mounted to the hub around the shaft and near a top of central tube. An annular space for receiving oil for the bearing is defined in the hub at a location between the shaft and the oil retaining ring.

Other advantages and novel features of the present invention will be drawn from the following detailed description of the preferred embodiments of the present invention with attached drawings, in which:

DETAILED DESCRIPTION OF PREFERRED EMBODIMENTS

Figure 1:
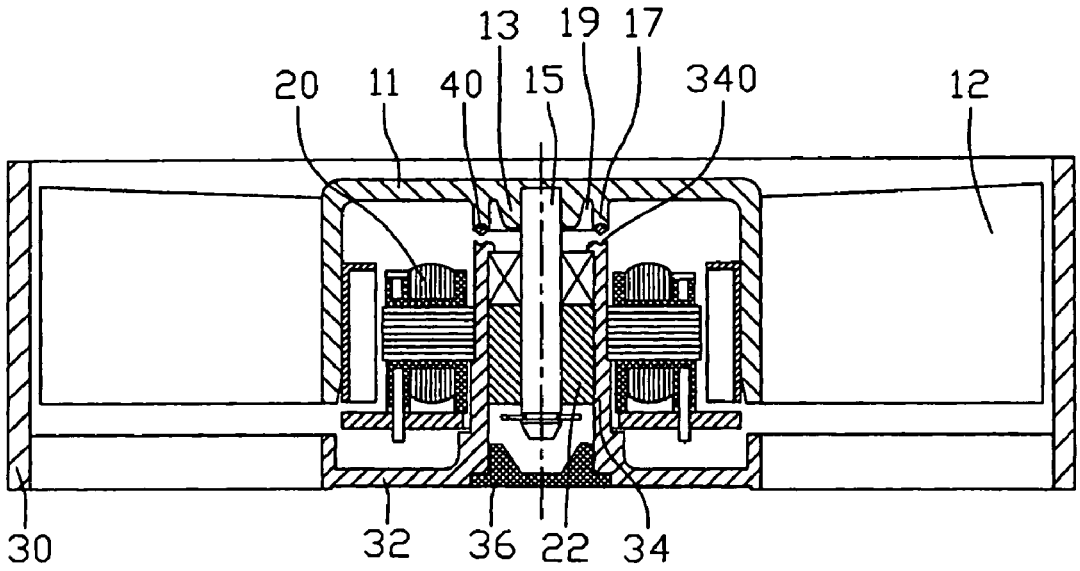
FIG. 1 is a cross sectional view of a cooling fan in accordance with a preferred embodiment of the present invention.
Figure 2:
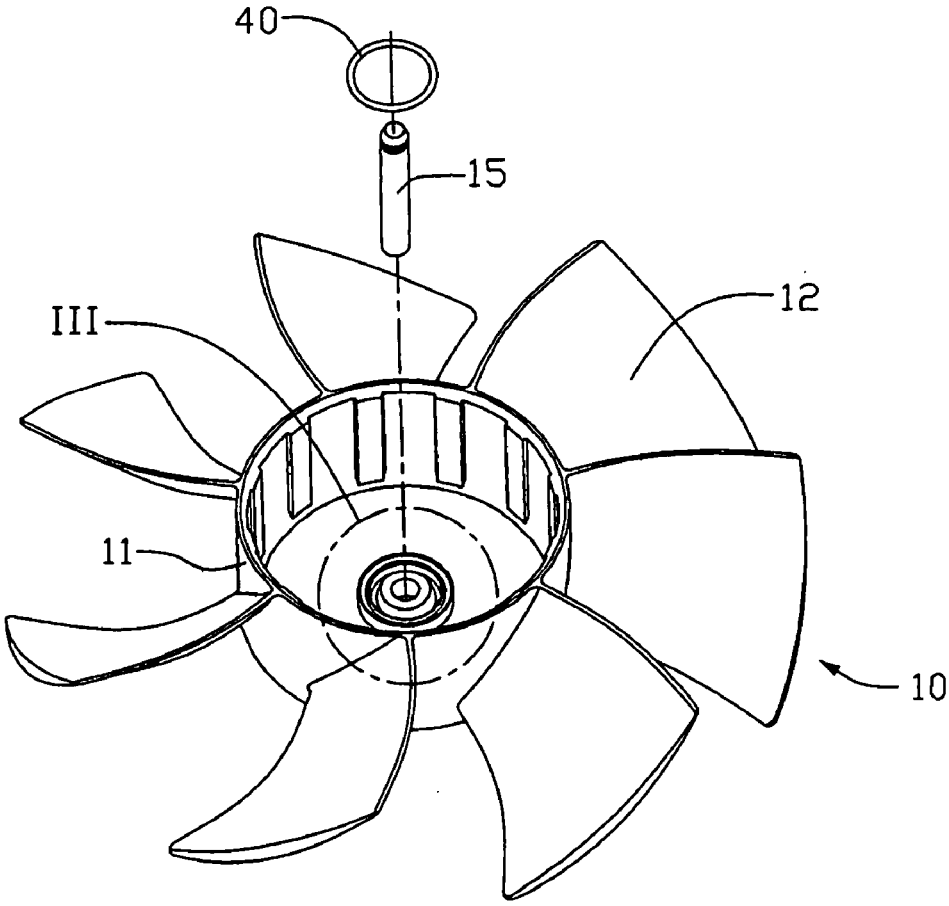
FIG. 2 is an exploded, isometric view of a rotor and an oil retaining ring of the cooling fan of FIG. 1, as viewed from a bottom aspect.
Figure 3:
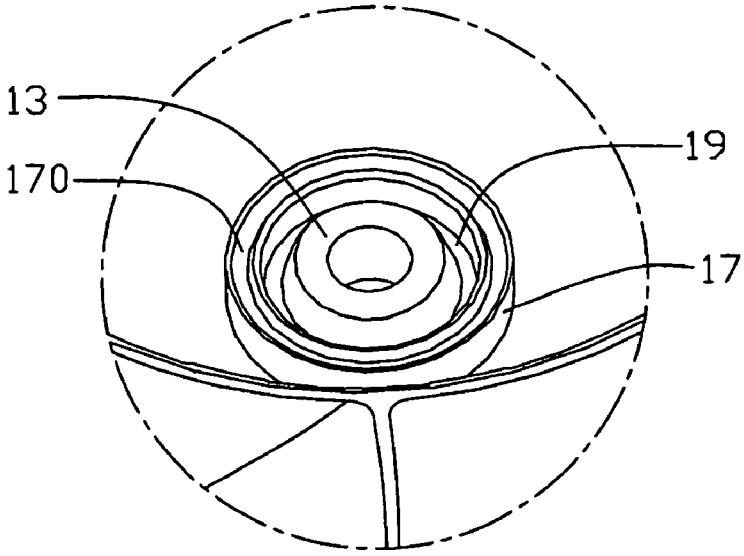
FIG. 3 is an enlarged view of a circled portion III of FIG. 2.
Figure 4:
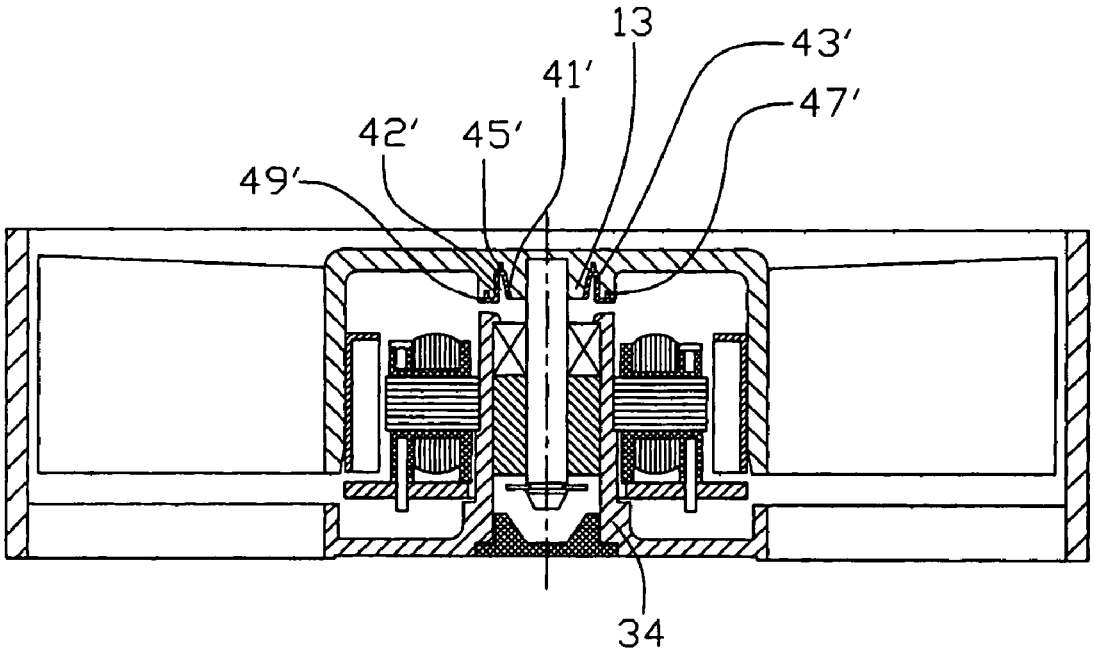
FIG. 4 is a cross sectional view of a cooling fan in accordance with an alternative embodiment of the present invention.
Figure 5:
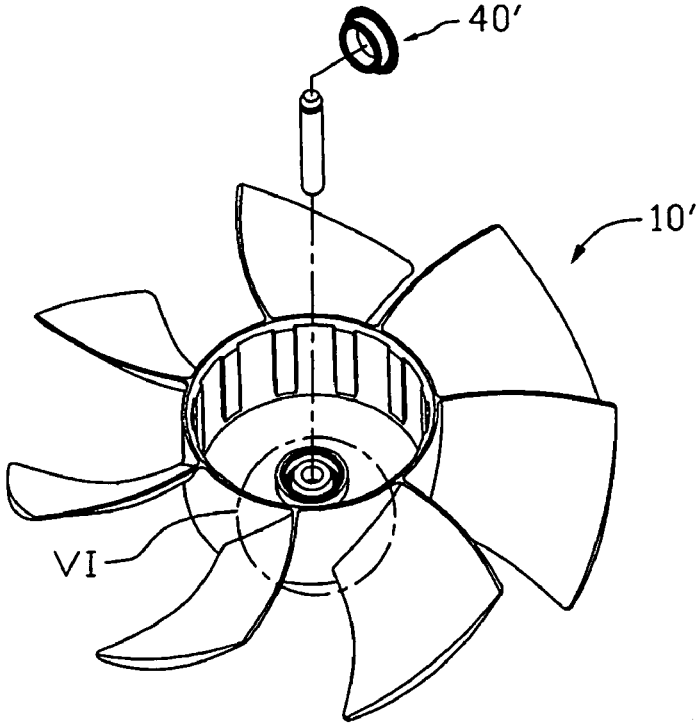
FIG. 5 is an exploded, isometric view of a rotor and an oil retaining ring of the cooling fan of FIG. 4, as viewed from a bottom aspect.
Figure 6:
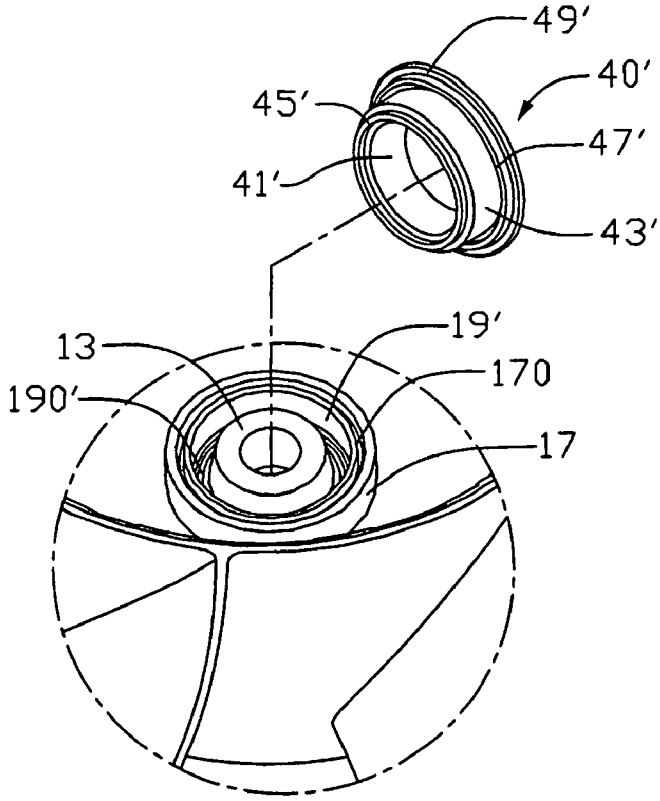
FIG. 6 is an enlarged view of a circled portion VI of FIG. 5 and the oil retaining ring.
Figure 7:
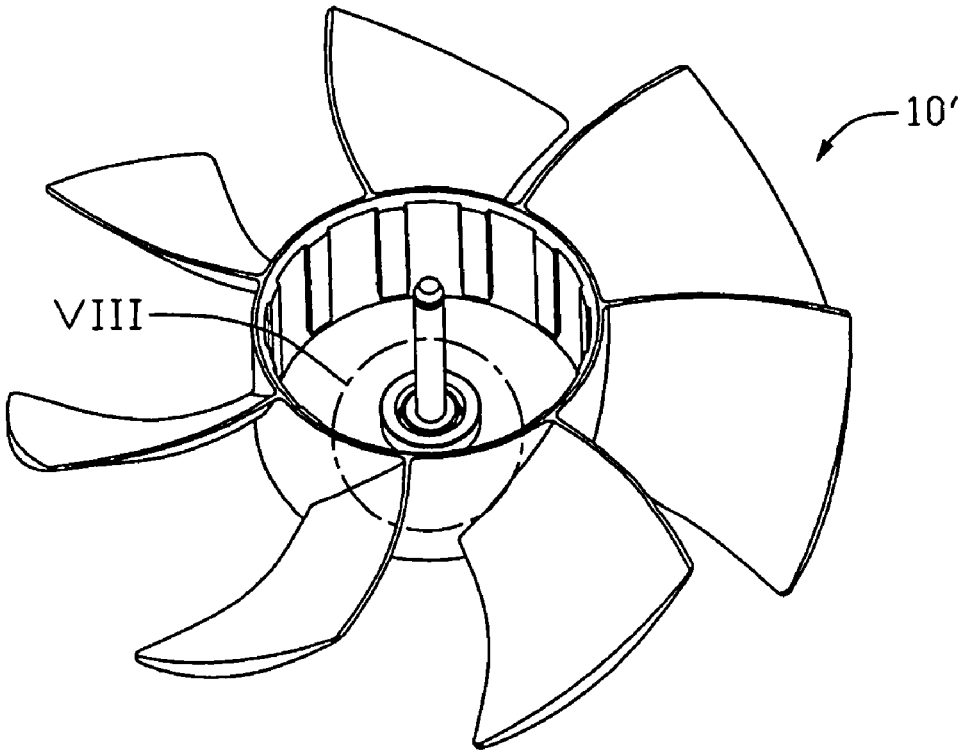
FIG. 7 is an assembled, isometric view of the rotor of FIG. 5.
Figure 8:
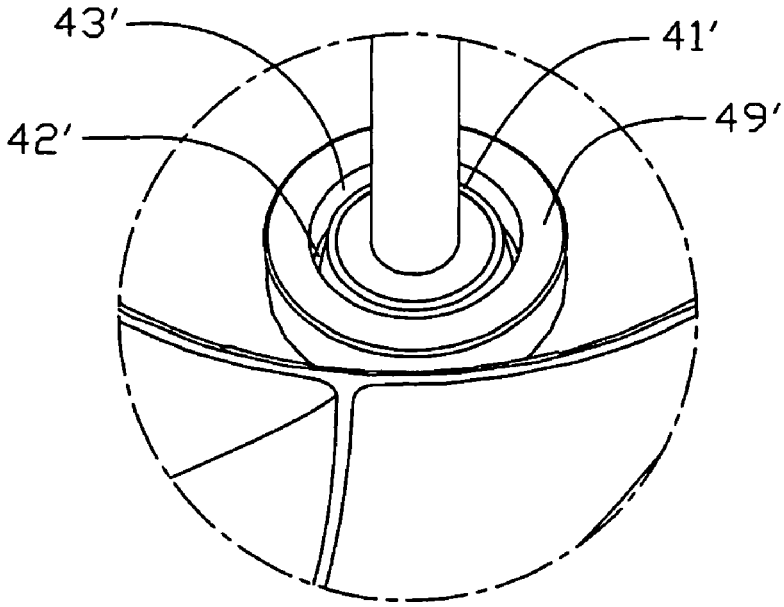
FIG. 8 is an enlarged view of a circled portion VIII of FIG. 7.

Referring to FIGS. 1 through 3, a cooling fan according to a preferred embodiment of the present invention comprises a rotor 10, a stator 20 in respective to which the rotor 10 is rotatable, a frame 30 receiving the rotor 10 and the stator 20 therein, and an oil retaining ring 40 mounted on the rotor 10.

The frame 30 comprises a base 32 and a central tube 34 extending upwardly form a central portion of the base 32. A sealing cap 36 couples to and seals a bottom end of the central tube 34. An annular recess 340 is formed on a top end of the central tube 34. The stator 20 is mounted around the central tube 34.

The rotor 10 comprises a hub 11 forming a shaft seat 13 at a central portion, a plurality of fan blades 12 extends radially from an outer periphery of the hub 11, and a shaft 15 received in the shaft seat 13 extending downwardly from a central portion of the shaft seat 13. An annular protrusion 17 around the shaft seat 13 extends downwardly from the hub 11. The protrusion 17 and the shaft seat 13 cooperatively define an annular space 19 therebetween. An annular groove 170 is defined in a bottom end of the protrusion 17.

The cooling fan further comprises a bearing 22 mounted in the central tube 34, and the stator 20 includes windings arranged around the central tube 34 to establish alternating magnetic field interacting with the magnetic field of the rotor 10 to drive the rotor 10 to rotate. A through hole is defined in the center of the bearing 22 for receiving the shaft 15 therein.

The oil retaining ring 40 is received in the groove 170 of the protrusion 17. A gap is formed between a bottom end of the oil retaining ring 40 and a top surface of the central tube 34. The distance between the bottom end of the oil retaining ring 40 and the recess 340 in an axial direction of the central tube 34 is smaller than the distance between a bottom end of the shaft seat 13 and the top surface of the central tube 34.

During operation of the cooling fan, the oil escapes along the rotating shaft 15 by the centrifugal force generated by the rotation of the shaft 15. Part of the escaping oil is received in the space 19 firstly and then flows back to the bearing 22; the other part of the escaping oil flows back to the bearing 22 by the restriction of the oil retaining ring 40. Therefore the oil can be kept from leaking out of the bearing 22. Further, because the oil retaining ring 40 is mounted in the groove 170 of the protrusion 17 and forms a gap to the central hub 34, then the friction between the oil retaining ring 6 and the bearing 3 of prior art cooling fan is avoided by the present invention and thus the useful life of the cooling fan of the present invention is prolonged. Also during assembly or the cooling fan subject to vibrations or shocks, the oil retaining ring 40 and the recess 340 of the central tube 34 can act as a buffer and then avoid the rotor 10 to hit directly with the central tube 34.

Referring to FIGS. 4 through 8, they illustrate an alternative embodiment of the present invention. Except for an oil retaining ring 40' and a space 19', other parts of the cooling fan in accordance with this second embodiment have substantially the same configuration with the cooling fan of the previous first preferred embodiment.

The oil retaining ring 40' comprises an annular first wall 41' and an annular second wall 43' enclosing the first wall 41'. The first wall 41' and the second wall 43' are connected together at a top end and are separated at a bottom end, thus define a channel 42' therebetween for receiving the escaping oil during operation of the cooling fan. An annular first rib 45' extends from the junction of the first wall 41' and the second wall 43' to an opposite side of the channel 42'. An annular flange 49' extends outwardly from an outer periphery of the second wall 43' near the bottom end of the oil retaining ring 40', and an annular second rib 47' extends from an upper surface of the flange 49'. An annular slot 190' is defined at the junction of the shaft seat 13 and the protrusion 17 for receiving the first rib 45' therein. The slot 190' is in communication with the space 19'.

When assembled together, the oil retaining ring 40' is mounted on the rotor 10'. The first wall 41' and the second wall 43' are received in the space 19' and the first wall 41' abuts an outer surface of the shaft seat 13 and the second wall 43' abuts an inner surface of the protrusion 17. The first rib 45' is received in the slot 190', and the second rib 47' is received in the groove 170 of the protrusion 17. The flange 49' covers the bottom end of the protrusion 17 and forms a gap with the top of the central tube 34 therebetween. Also the distance between the bottom end of the flange 49' and the top surface of the central tube 34 in the axial direction of the central tube 34 is smaller than the distance between the bottom end of the shaft seat 13 and the top surface of the central tube 34.

Figure 9:
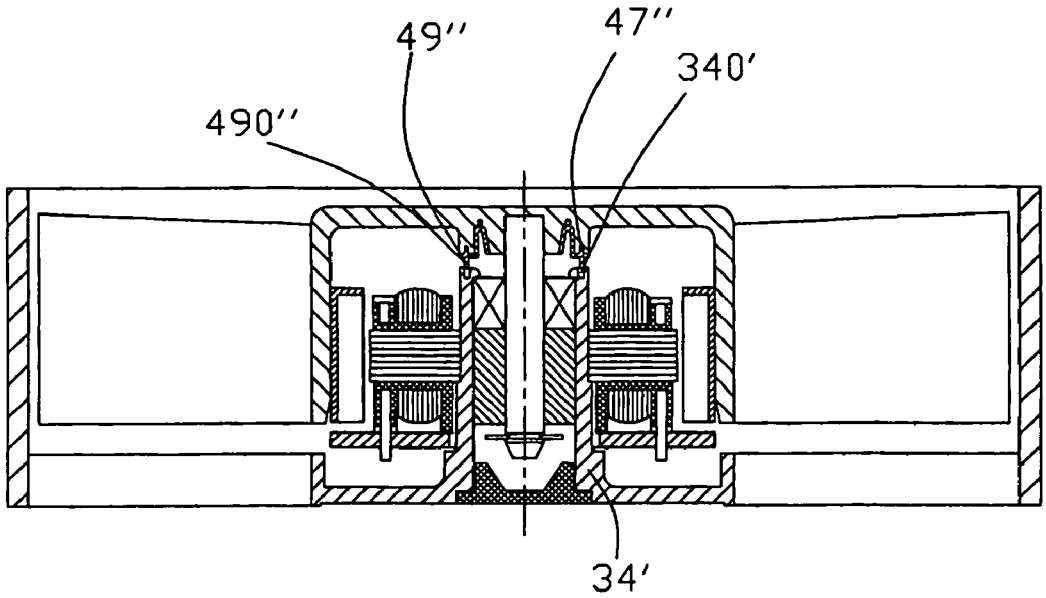
FIG. 9 is a cross sectional view of a cooling fan in accordance with an another embodiment of the present invention.
Figure 10:
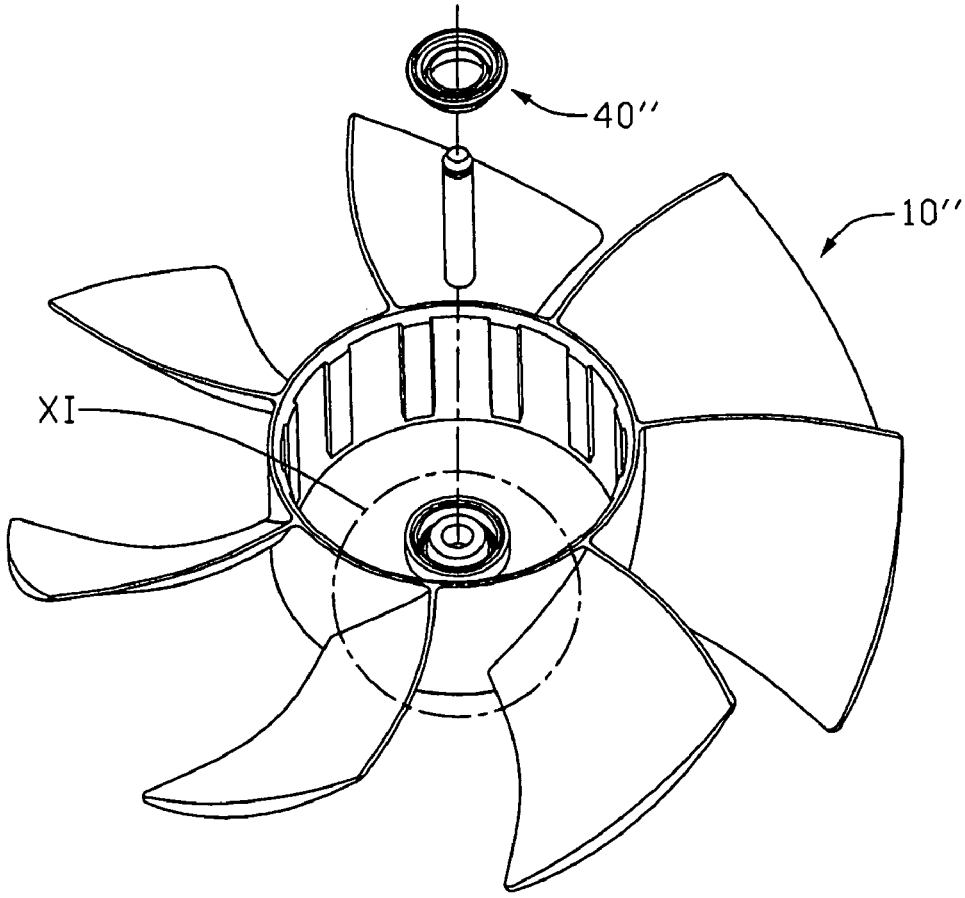
FIG. 10 is an exploded, isometric view of a rotor and an oil retaining ring of the cooling fan of FIG. 9, as viewed from a bottom aspect.
Figure 11:
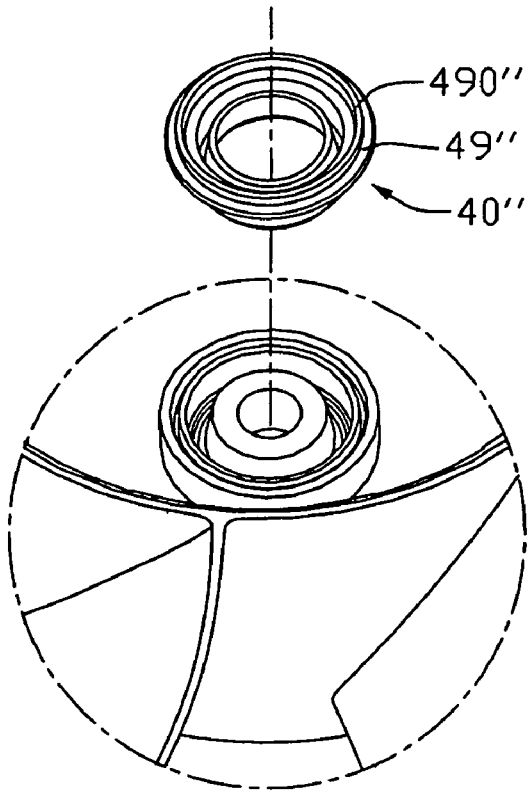
FIG. 11 is an enlarged view of a circled portion XI of FIG. 10 and the oil retaining ring.
Figure 12:
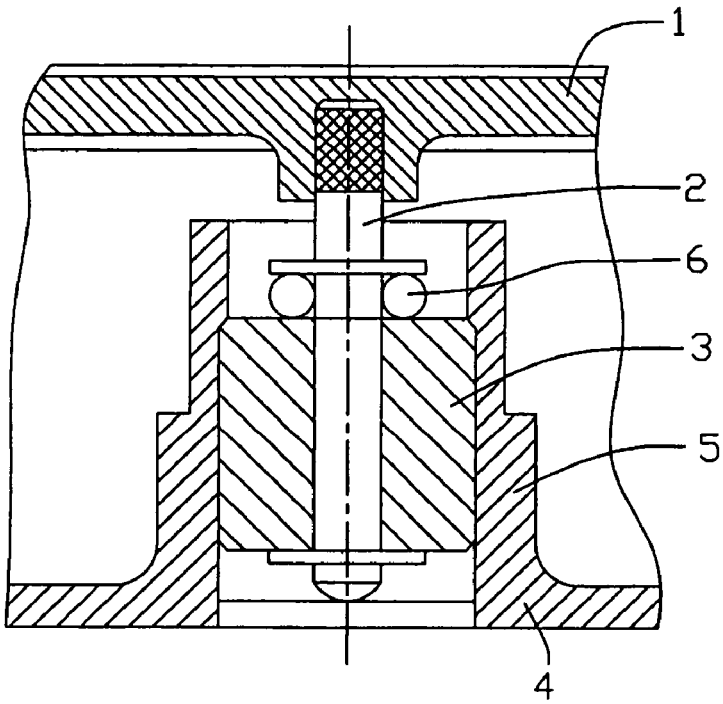
FIG. 12 (PRIOR ART)
FIG. 12 is a cross sectional view of a conventional cooling fan.

Referring to FIGS. 9 through 11, they illustrate another embodiment of the present invention. This third embodiment is substantially the same as the previous second embodiment. The only difference between this third embodiment and the second embodiment is in that an oil retaining ring 40" in accordance with the third embodiment has an additional annular third rib 490". The third rib 490" extends downwardly from a flange 49" (the same as the flange 49' of the second embodiment) at a bottom of the oil retaining ring 40". The third rib 490" is located just below a second rib 47" (the same as the second rib 47' of the second embodiment). The third rib 490" has a height which is larger than a depth of a recess 340' formed on the top of a central tube 34'. When assembled together a lower portion of the third rib 490" is received in the recess 340'. The third rib 490' maintains a distance between a rotor 10" and the central tube 34'. Therefore, a direct hitting or impact of the central tube 34' by the rotor 10" due to vibration or shock on the cooling fan is avoided.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A cooling fan comprising:

a frame comprising a base having a central tube extending upwardly from the base;

a bearing received in the central tube;

a stator mounted around the central tube;

a rotor comprising a hub having a shaft extending from the hub into the bearing, the rotor being rotatable in respective to the stator; and an oil retaining ring mounted to the hub around the shaft and near a top of the central tube;

wherein the hub has a shaft seat engaging with a top end of the shaft; and wherein a protrusion is formed on the hub around the shaft seat, a groove is defined in a bottom end of the protrusion for receiving the oil retaining ring therein.

2. The cooling fan as described in claim 1, wherein a recess is defined on the top surface of the central tube corresponding to the oil retaining ring.

3. The cooling fan as described in claim 2, wherein a distance between a bottom end of the oil retaining ring and the recess of the central tube in an axial direction of the central tube is smaller than a distance between a bottom end of the shaft seat and the top surface of the central tube.

4. The cooling fan as described in claim 1, wherein the shaft seat and the protrusion cooperatively define an annular space therebetween.

5. The cooling fan as described in claim 4, wherein the oil retaining ring comprises a first wall and a second wall surrounding the first wall and connected at a top end and separated at a bottom end of the oil retaining ring whereby a channel is defined in the bottom of the oil retaining ring, the first and second wall being received in the annular space.

6. The cooling fan as described in claim 5, wherein the first wall abuts an outer surface of the shaft seat and the second wall abuts an inner surface of the protrusion.

7. The cooling fan as described in claim 5, wherein a first rib extends from the junction of the first wall and the second wall at an opposite side to the space, and a slot is defined at a junction of the shaft seat and the protrusion for receiving the first rib therein.

8. The cooling fan as described in claim 5, wherein a flange extends outwardly from an outer periphery of the second wall.

9. The cooling fan as described in claim 8, wherein a second rib extends from an upper surface of the flange and is received in the groove of the protrusion.

10. The cooling fan as described in claim 8, wherein a third rib extends from a lower surface of the flange corresponding to the recess of the central tube.

11. The cooling fan as described in claim 10, wherein a distance between a bottom end of the third rib and a recess in a top of the central tube in an axial direction of the central tube is smaller than a distance between a bottom end of the shaft seat and the top surface of the central tube.

12. A cooling fan comprising:

a frame having a central tube extending upwardly;

a stator mounted on the central tube;

a bearing received in the central tube;

a rotor having a shaft rotatably engaging with the bearing and rotating when magnetically interacts with the stator, the hub having a central shaft seat fixedly engaging with the shaft and a downwards protrusion surrounding the shaft seat; and an oil retaining ring mounted on the protrusion at a location close to a top of the central tube;

wherein an annular space is defined between the protrusion and the shaft seat for receiving lubricating oil escaping from the bearing when the fan is operated.

13. The cooling fan as described in claim 12, wherein the oil retaining ring is mounted on a bottom end of the protrusion, the top of the central tube defines a recess therein, and the oil retaining ring faces the recess.

14. A cooling fan comprising:

a frame having a central tube extending upwardly;

a stator mounted on the central tube;

a bearing received in the central tube;

a rotor having a shaft rotatably engaging with the bearing and rotating when magnetically interacts with the stator, the hub having a central shaft seat fixedly engaging with the shaft and a downwards protrusion surrounding the shaft seat; and an oil retaining ring mounted on the protrusion at a location close to a top of the central tube;

wherein an annular space is defined between the protrusion and the shaft seat, and the oil retaining ring has first wall and second wall received in the annular space, the first wall abutting against the shaft seat, the second wall abutting the protrusion, the first and second walls defining a channel therebetween facing downwardly; and wherein the oil retaining ring has a flange at a bottom thereof, the flange covering a bottom of the protrusion.

15. The cooling fan as described in claim 14, wherein the oil retaining ring has a rib formed on the flange and extending toward the top of the central tube.

* * * * *